US006159647A

United States Patent [19]

Anno et al.

[11] Patent Number: 6,159,647

[45] **Date of Patent: *Dec. 12, 2000**

[54] NON-MAGNETIC YELLOW TONER

[75] Inventors: Masahiro Anno, Sakai; Chikara Tsutsui, Nishinomiya; Minoru Nakamura, Itami; Katsunori Kurose, Amagasaki; Hiroyuki Fukuda, Sanda, all of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/127,551

[22] Filed: Aug. 3, 1998

[30] Foreign Application Priority Data

Aug. 4, 1997 [JP] Japan ..... 9-208873
Aug. 21, 1997 [JP] Japan ..... 9-224798

[51] Int. Cl.[7] ..... G03G 13/06; G03G 9/09

[52] U.S. Cl. ..... 430/45; 430/106; 430/111; 430/903

[58] Field of Search ..... 430/106, 109, 430/111, 903, 45

[56] References Cited

U.S. PATENT DOCUMENTS 4,987,454 1/1991 Natsuhara et al. ..... 355/259
5,240,803 8/1993 Ota ..... 410/106
5,438,395 8/1995 Koga et al. ..... 355/253
5,476,744 12/1995 Anno ..... 430/137
5,578,407 11/1996 Kasuya et al. ..... 430/106
5,622,802 4/1997 Demizu et al. ..... 430/106
5,660,964 8/1997 Machida et al. ..... 430/110
5,843,605 12/1998 Anno et al. ..... 430/106
5,885,743 3/1999 Takayanagi et al. ..... 430/109

*Primary Examiner*—John Goodrow
*Attorney, Agent, or Firm*—Burns, Doane, Swecker & Mathis, LLP

[57] ABSTRACT

The present invention relates to a non-magnetic yellow toner for use in full-color image forming apparatuses, such as full-color electrostatic copying machines and full-color laser beam printers, comprising:

non-magnetic toner particles containing a binder resin having an acid value of 1 to 30 KOHmg/g, and a coloring material composed of a compound classified as C. I. pigment yellow 180;

the toner particles having a roundness of 0.94 to 1.0, a standard roundness deviation of not more than 0.045, and a volume mean particle size of 2 to 9 $\mu$m.

21 Claims, 4 Drawing Sheets

NON-MAGNETIC YELLOW TONER

RELATED APPLICATIONS

The present invention is based on Japanese Patent Application Nos. 9-208,873 and 9-224,798, the contents of which are incorporated herein by reference.

BACKGROUND OF THE INVENTION

1. Field of the Invention

The present invention relates to a developing agent for electrostatic latent image development and, more particularly, to a non-magnetic yellow toner for use in full-color image forming apparatuses, such as full-color electrostatic copying machines and full-color laser beam printers.

2. Description of the Related Art

An image forming method in which an electrostatic latent image formed on an electrostatic latent image supporting member, such as a photosensitive member, is developed by using a toner, and in which the developed toner image is transferred onto a recording material, such as recording paper, for image formation has been widely used in copying machines, printers, facsimile, and the like. Recently, a full-color image forming apparatus has been put in practical use such that multicolor image reproduction can be made by superposing toners of plural colors one over another.

In such a full-color image forming apparatus, an electrostatic latent image is formed in dot units on an organic photosensitive member charged negatively by digital writing, for example, light beam irradiation, and the latent image is reversal-developed by using negatively chargeable magenta toner, cyan toner, yellow toner and, where necessary, black toner, and toner images of different colors are superposed one over another thereby to achieve multicolor image reproduction.

Above described full-color image forming method is largely employed in reproducing pictures, photographs, graphic images, and the like, and multicolor image reproduction is carried out by superposing color toners of plural colors one over another as stated above. Such a multi-color imaging method is used not only for image formation on recording paper, but also is generally adopted for use with an overhead projector sheet (OHP sheet). Therefore, it is required that toner must have a spectral reflectance corresponding to the desired color and good transmittance such that an underlying toner color is not concealed when color toners are superposed one over another. This requirement is particularly pronounced with respect to yellow toner, a toner of pale color.

Known organic pigments and dyes have been conventionally used as coloring agents for yellow toner. However, such pigments and dyes have their inherent shortcomings. In the case of dyes, for example, while they generally have high permeability and good colorfulness because the dye is present in such a condition that the dye is dissolved in the binding resin of the toner, they have a disadvantage that their resistance to heat and to light is rather low. The low resistance to light leads to fading due to light. Therefore, even when a highly colorful image is obtained, the problem is that the colorfulness cannot be long maintained. The low resistance to heat is apt to cause a problem such that when thermal fixation is carried out, the dye is sublimated in the vicinity of the fixing section, resulting in some interior stain. Another problem is that some dye is liable to become dissolved in a release agent, such as silicone oil, applied to the fixing roller, resulting in image stains or the like. In view of these problems, it is preferable to use pigments. However, pigments are so cohesive that it is difficult to finely and uniformly disperse the pigment in the toner, and as a result the hiding effect of the toner is so high as to lower the permeability of the toner itself. Another problem with pigments is that if agglomeration of pigment particles occurs, the agglomerated particles cause light scattering with the result that any sufficient spectral reflection for accurately reproducing a document cannot be obtained. Another problem is that since pigments have high hiding power as stated above, no sufficient permeability could be obtained. Therefore, when the toner is used with an OHP sheet, the projected image is dark and has poor chroma. Further, some pigments have low resistance to heat such that the pigment is decomposed during the process of toner preparation or during the stage of heat fixing.

Whilst, as earlier stated, full-color toners are required to have good transferability for reproducing a multi-color image by superposing toners of different colors one over another. If the charged amount of the toner is too high, the strength of toner adhesion to the photosensitive member tends to increase, resulting in lowered transferability of the toner. In such a case, even if the toner charge is broadly distributed, there will occur some degradation in transferability. With full-color toners, therefore, it is required that the toner must have a proper charge amount and a proper charge distribution. Such a requirement is particularly pronounced in the case where toners are transferred by means of a transfer roller onto an intermediate transfer member on which toners of different colors are superposed one over another so that the superposed toners are transferred by the transfer roller onto a transfer sheet.

Recently, size reduction has been considered with respect to full-color image forming apparatuses and, to this end, it is required that developing units must be reduced in size. The reason for this is that a full-color image forming apparatus requires four developing units for accommodating cyan developing agent, yellow developing agent, magenta developing agent, and black developing agent respectively. For the purpose of size reduction with respect to a developing apparatus, it is advantageous to use a non-magnetic mono-component developing apparatus which does not require an agitator mechanism for stirring the toner and carrier into mixture. With the non-magnetic mono-component developing apparatus in which no carrier is used, however, the toner is required to have a prompt rise behavior to quickly give a proper charge quantity, because the toner is charged through its contact with the developer supporting member and/or developer regulating member.

SUMMARY OF THE INVENTION

It is a primary object of the present invention to provide a non-magnetic, yellow toner for full-color image formation which solves the foregoing problems.

It is another object of the invention to provide a non-magnetic yellow toner having high permeability and high color reproducibility.

It is another object of the invention to provide a non-magnetic yellow toner having a proper amount of electrical charge and a proper electrical charge distribution.

It is another object of the invention to provide a non-magnetic yellow toner which exhibits good transferability during a multi-color image-forming process.

It is a further object of the invention to provide a non-magnetic mono-component yellow toner.

The objects of the present invention can be achieved by a non-magnetic yellow toner, comprising:

non-magnetic toner particles containing a binder resin having an acid value of 1 to 30 KOHmg/g, and a coloring material composed of a compound classified as C. I. pigment yellow 180;

the toner particles having a roundness of 0.94 to 1.0, a standard roundness deviation of not not more than 0.045, and a volume mean particle size of 2 to 9 $\mu$m.

DETAILED DESCRIPTION OF THE INVENTION

Figure 1:
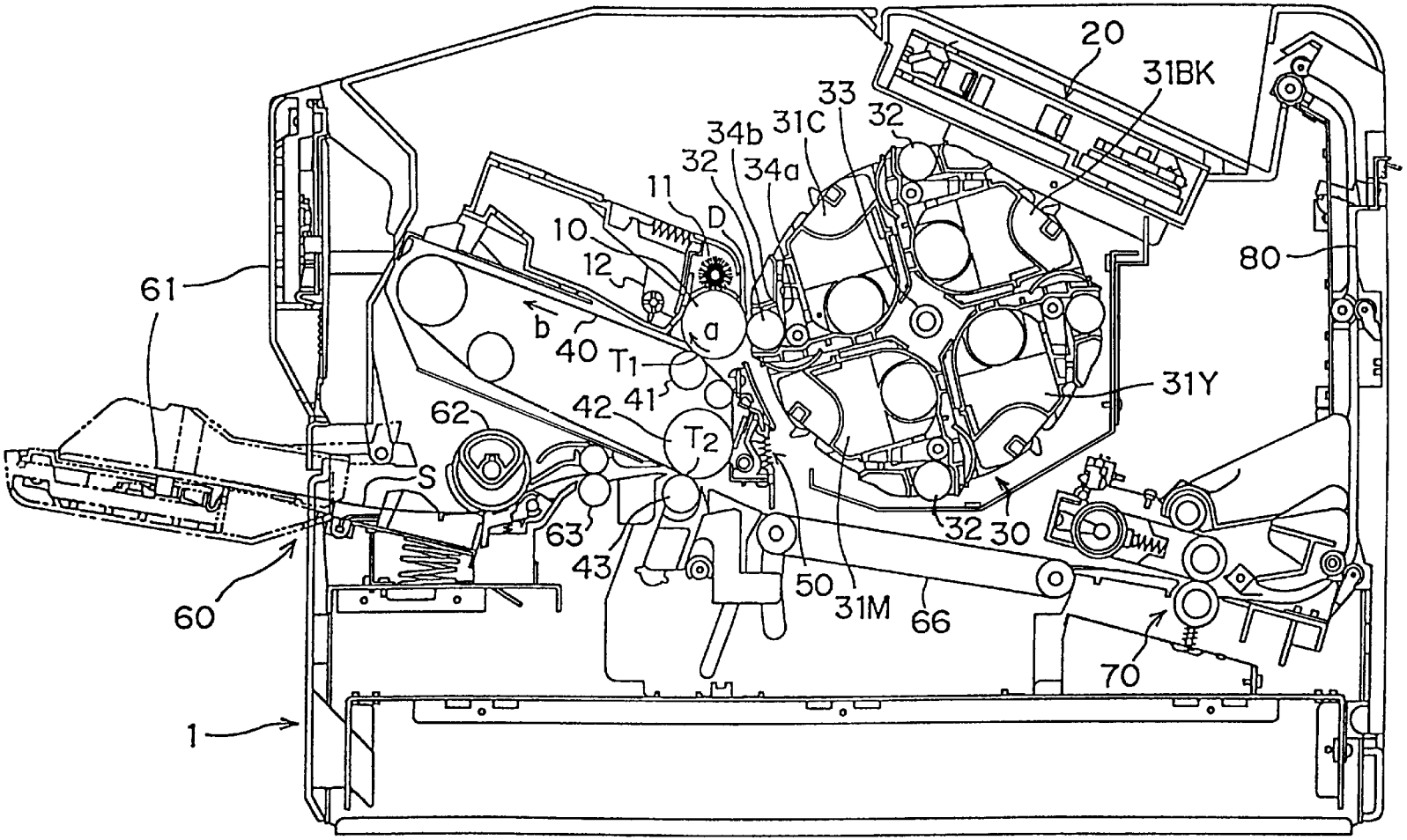
FIG. 1 is a schematic explanatory view of a full-color printer of a non-magnetic mono-component development system.

In accordance with the present invention, toner particles for a full-color non-magnetic developing agent contain, as a yellow coloring material a compound classified as C. I. pigment yellow 180. A toner containing C. I. pigment yellow 180 exhibits high transmittance and high color reproducibility. Furthermore, since C. I. pigment yellow 180 has high resistance to light and high heat resistance, even when heated during the process of toner preparation or at the stage of fixation, the pigment will not be decomposed to produce any harmful substance and, therefore, does afford handling safety. If the pigment content is too small, no sufficient chromaticity could be obtained. If the pigment content is too large, its effect upon toner charging is pronounced. Therefore, the quantity of C. I. pigment yellow 180 contained in the toner is preferably 2 to 15 parts by weight relative to 100 parts by weight of the binder resin.

Whilst, in order to enhance the dispersion of C. I. pigment yellow 180 in the binder resin, it is necessary to use a binder resin having an acid value of 1.0 to 30.0 KOHmg, preferably 1.0 to 25.0 KOHmg/g, more preferably 2.0 to 20.0 KOHmg/g. If the acid value is less than 1.0 KOHmg/g, its effect for dispersion improvement is insignificant, whereas if the acid value is more than 30.0 KOHmg, negative chargeability is pronounced and, in addition, a substantial change may occur in the quantity of charge due to any environmental change.

Any binder resin having such acid value can be used in the present invention irrespective of the kind of the resin. For example, styrene-acrylic copolymer resins, polyester resins, and epoxy resins are usable in one kind alone or in a mixture of two or more kinds. Particularly preferred of these resins are polyester resins.

In the present invention, a preferred polyester resin is a linear polyester resin which is produced as a polycondensation product comprising an alcoholic component, mainly bisphenol A alkylene oxide adduct, and an acid component including a phthalo-dicarboxylic acid or a combination of a phthalo-dicarboxylic acid and a fatty dicarboxylic acid.

For the bisphenol A alkylene oxide adduct, bisphenol A propylene oxide adduct and bisphenol A ethylene oxide adduct are preferred; and it is desirable that these adducts be used in mixture.

For the alcoholic component, some of the below-mentioned diols and polyvalent alcohols may be used in combination with bisphenol A alkylene oxide adduct. Examples of such alcoholic component are diols, such as ethylene glycol, diethylene glycol, triethylene glycol, 1,2-propylene glycol, 1,3-propylene glycol, 1,4-butanediol, and neopentyl glycol; sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylolethane, trimethylolpropane, and 1,3,5-trihydroxymethylbenzene.

Phthalo-dicarboxylic acids usable in the present invention include, for example, terephthalic acid, and isophthalic acid, and their anhydrides or lower alkyl esters.

For purposes of adjusting the acid value of the resin, a small amount of a polyvalent carboxylic acid, such as trimellitic acid, may be used as long as such addition does not affect the light transmittance, for example, of the toner. Examples of such polyvalent carboxylic acid components are: 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methyl-2-methylenecarboxypropane, 1,2,4-cyclohexane tricarboxylic acid, tetra (methylene carboxyl) methane, 1,2,7,8-octane tetracarboxylic acid, and pyromellitic acid, and their anhydrides and lower alkyl esters.

In the present invention, the binder resin has a glass transition point of 55 to 75° C., preferably 58 to 70° C., a softening point of 95 to 120° C., preferably 100 to 118° C., and a number-mean molecular weight of 2500 to 6000, preferably 3000 to 5500, with the ratio of weight-mean molecular weight/number-mean molecular weight being from 2 to 8, preferably from 3 to 7. If the glass transition point is lower, heat resistance of the toner is lowered. If the glass transition point is higher, light transmittance and color mixing capability of the toner are reduced. If the softening point is lower, high-temperature offset may easily occur during the step of fixing, whereas if the softening point is higher, the fixing strength of the toner is reduced. If the number-mean molecular weight is smaller, toner peel may easily occur when the image print is folded; and if the number-mean molecular weight is larger, the fixing strength of the toner is reduced. If the ratio of weight-mean molecular weight/number-mean molecular weight is smaller, high-temperature offset may easily occur, and if the ratio is larger, light transmittance of the toner is reduced.

Preferably, toner particles are loaded with a waxing material, such as polypropylene wax, polyethylene wax, carnauba wax, or Sazol wax. This is not only for anti-offset property improvement, but also for reducing the trouble of toner adhesion to a regulating member (blade) and/or developer support member (developer roller) in a non-magnetic mono-component developing apparatus. In particular, the use of a wax having an acid value of 0.5 to 30 KOHmg/g is preferable from the viewpoint of dispersion with respect to a binder resin having aforesaid acid value. Preferably, addition of such a wax is 0.5 to 5 parts by weight, more preferably 1 to 3 parts by weight, relative to 100 parts by weight of the binder resin. If the addition is less than 0.5 part by weight, no sufficient effect of the wax could be obtained, whereas if the addition is more than 5 parts by weight, the light permeability and color reproducibility of the toner would be reduced.

In the present invention, toner particles can be produced by a known method with no particular limitation. For example, it is possible to use the mulling-pulverizing method, suspension polymerization method, emulsion polymerization method, emulsion disperse granulation method, or encapsulation method in producing toners. In the case where C. I. pigment yellow 180, a yellow pigment, is to be added in the process of toner production, it is desirable to use a master-batched or flushed C. I. pigment yellow 180 from the standpoint of enhancing toner dispersion.

A master batch can be obtained by mixing 20 to 100 parts by weight of C. I. pigment yellow 180 with 100 parts by weight of the binder resin, melting and kneading the mixture, followed by cooling, then pulverizing the cooled kneaded mixture.

In accordance with the present invention, it is desirable that toner particles be conditioned to a volume-mean particle size of 2 to 9 $\mu$m, preferably 2 to 7 $\mu$m, from the standpoint of high-precision image reproduction. Further, from the standpoints of narrowing the area of toner charge distribution and preventing fogs, it is necessary that the toner should have a particle size distribution such that the toner contains not more than 2% by weight, preferably not more than 1% by weight, of toner particles having a particle size of not less than two times the volume mean particle size thereof, and not more than 5% by number of toner particles having a particle size of not more than one third of the volume mean particle size.

Measurement of particle size and particle size distribution of toner particles was made using a Coulter Multisizer (made by Coulter Counter K. K.), with an aperture diameter set at 50 $\mu$m.

In accordance with the present invention, it is required that toner particles should have a mean roundness of 0.94 to 1.0, and a standard deviation of particle roundness of not more than 0.045. If the mean roundness is less than 0.94, the electrostatic adhesive force of toner particles against the image supporting member and/or intermediate transfer medium will become so strong as to cause unsatisfactory transfer. If the standard deviation of toner particle roundness is more than 0.045, charge variations will become large among individual toner particles, resulting in fogging and unsatisfactory transfer. From above stated view points, therefore, a mean roundness range is preferably 0.945 to 0.99, more preferably 0.95 to 0.98, and the standard deviation of roundness is preferably not more than 0.040, more preferably not more than 0.035.

It is noted that mean roundness is expressed by (perimeter of a circle corresponding to particle size/perimeter of projected particle image), and that measurement of the mean roundness was made in an aqueous dispersion system using a flow-type particle image analyzer (FPIA-1000; Toa Iyo Denshi K. K.). The term "circle corresponding to particle size" used herein means a circle having an area equal to the projected area of the particle.

The roundness of toner particles and standard deviation of such roundness can be controlled by manufacturing conditions for toner particle production. In the kneading-pulverizing method, for example, toner particles are produced through the steps of material mixing, melting-kneading, pulverizing, and classifying. In this case, the roundness and the like can be controlled by employing a pulverizing apparatus which can pulverize subject particles to a spherical shape. Examples of such pulverizing apparatus are "Inomizer System" (made by Hosokawa Micron K. K., and "Criptron System" (made by Kawasaki Jyukogyou K. K.). Also, the roundness of particles can be controlled by employing a classifying apparatus which can give a spherical shape to subject particles at the classifying step. An example of such a classifying apparatus is "Teeplex" classifier (Hosokawa Micron K. K.).

Toner particles obtained through the steps of material mixing, melt-kneading, pulverizing, and classifying may be treated by a surface treatment apparatus for roundness conditioning. Examples of such treatment apparatus are surface modifiers incorporating the high-speed air current impacting technique, such as "Hybridization System" (Nara Kikai Seisakusho K. K.), "Cosmos System" (Kawasaki Jyukogyo K. K.), and "Inomizer System" (Hosokawa Micron K. K.); surface modifiers incorporating the dry-system mechanochemical technique, such as "Mechanofusion System" (Hosokawa Micron K. K., and "Mechanomill" (Okada Seiko K. K.); surface modifiers incorporating the hot air current treatment technique, such as "Surfusing System", and surface modifiers incorporating the wet coating technique, such as "Dispacoat" (Nisshin Seifun K. K.) and "Coatmizer" (Freund Sangyo K. K.).

In the present invention, C. I. pigment yellow 180 is used as a coloring agent and, therefore, it is possible to produce toner particles having aforesaid level of roundness by using the emulsion dispersion method. In the emulsion dispersion method, a colored resin solution having a binder resin and a coloring agent dissolved or dispersed in a suitable organic solvent is prepared and the resin solution is added to an aqueous dispersion, the mixture being then stirred for being formed into droplets of colored resin solution. Then, heating is carried out to remove any organic solvent from the droplets. Toner particles are thus formed into shape. Even when toner particles are prepared according to the emulsion dispersion method in this way, the use of any yellow coloring agent other than C. I. pigment yellow 180 may result in poor permeability of the toner or may adversely affect the roundness of toner particles.

In the present invention, a colored resin solution comprising at least a binder resin, C. I. pigment yellow 180 and a non-aqueous organic solvent is first prepared.

The non-aquecus organic solvent is used for dissolving or dispersing a toner composition (including a binder resin, C. I. pigment yellow 180 and, where required, a charge control agent, wax and the like. For example, toluene, benzene, xylene, methylene chloride, chloroform, carbon tetrachloride, dimethyl ether, methyl acetate, ethyl acetate, butyl acetate, methyl propionate, ethyl p-opionate, butyl propionate, dimethyl oxalate, diethyl oxalate, dimethyl succinate, diethyl succinate, diethylene glycol dimethyl ether, diethylene glycol diethyl ether, diethylene glycol dibutyl ether, ethylene glycol monoacetate, diethylene glycol monoacetate, ethanol, propanol, butanol, diacetone alcohol, acetone, methyl ethyl ketone, methyl isobutyl ketone, N, N-dimethylformamide, 2-methoxyethanol, 2-ethoxyethanol, diethylene glycol monomethyl ether, diethylene glycol monoethyl ether, diethylene glycol monobutyl ether, dipropylene glycol monomethyl ether, dipropylene glycol monoethyl ether, 2-methoxyethyacetate, and 2-ethoxyethyl acetate may be used as such in one kind alone or in combination of two or more kinds.

In preparing a colored resin solution by dissolving or dispersing a toner composition in a non-aqueous organic solvent, various means may be used including ball mill, sand mill, homomixer, and ultrasonic homogenizer. The solid content concentration in the colored resin solution should be 5to 50% by weight, preferably 10 to 40% by weight so that droplets of an O/W type emulsion, prepared by emulsifiedly dispersing the colored resin solution in an aqueous dispersion, can be readily solidified into fine particles when the O/W type emulsion is heated for removing non-aqueous organic solvent from the droplets.

Next, an O/W type emulsion is prepared which comprises aforesaid colored resin solution emulsifiedly dispersed in an aqueous medium. The term "O/W type emulsion" used herein means a suspension such that an oily liquid (colored resin solution) is dispersed in the form of droplets in an aqueous medium.

Various methods may be employed in preparing an O/W type emulsion, including a method wherein aforesaid colored resin solution is added to an aqueous medium so that droplets of the colored resin solution are dispersed in the aqueous medium; and a method wherein an aqueous medium is added to the colored resin solution to cause a phase reversal so that droplets of the colored resin solution are dispersed in the aqueous medium. In addition to these methods, here exists a method using a micro-porous structure such that the colored resin solution (of dispersion phase) is dispersed through pores of the micro-porous structure into the aqueous medium (of continuous phase) thereby to form an O/W type emulsion.

Figure 2:
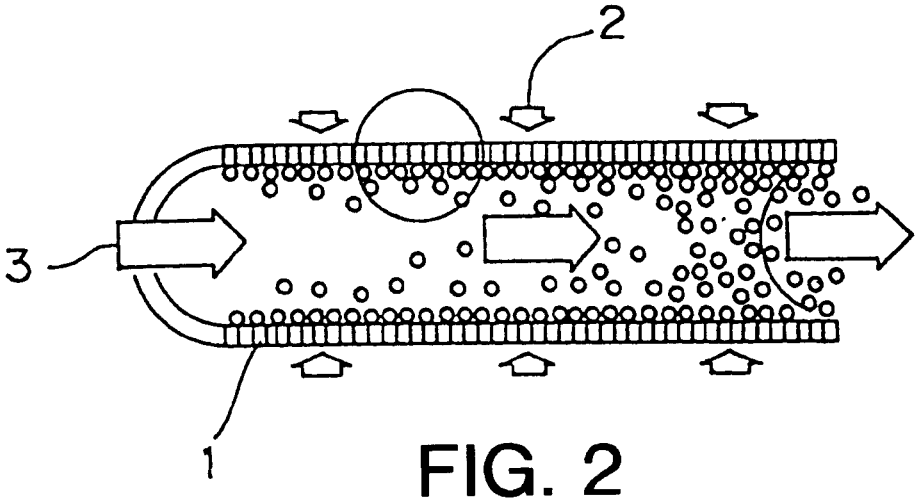
FIG. 2 is a schematic view for explaining an emulsion forming method using a micro-porous material.
Figure 3:
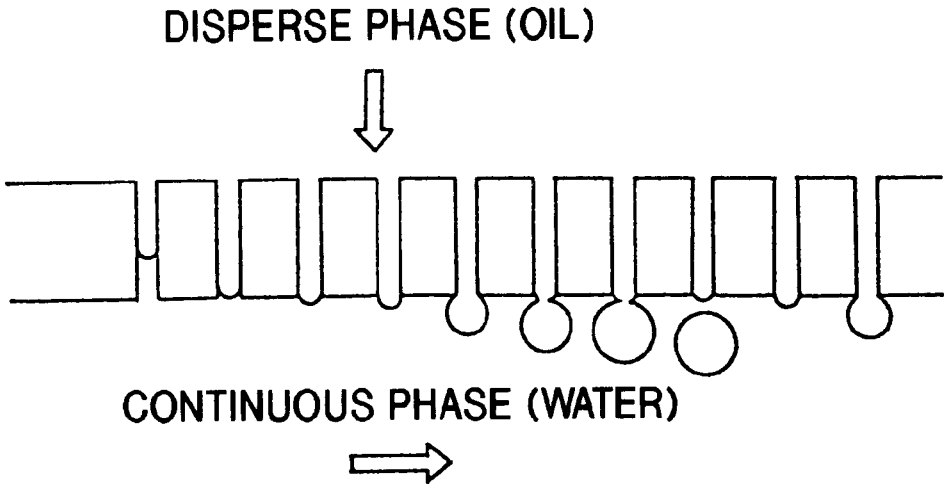
FIG. 3 is an enlarged sectional view of the micro-porous material.

FIG. 2 schematically shows a method of forming an O/W type emulsion; and FIG. 3 shows a portion (an encircled portion in FIG. 2) of a microporous structure on an enlarged scale. A colored resin solution (of dispersion phase) 2 is granulated in the form of droplets of uniform particle size by being forced into an aqueous medium (of continuous phase) 3 through pores of a micro-porous structure 1, whereby an O/W type emulsion with such droplets dispersed therein is formed. For details as to the formation of an O/W type emulsion using a micro-porous structure, reference is made to U.S. Pat. No. 5,476,744.

For stable formation of an O/W type emulsion, it is desirable that in the O/W type emulsion, the ratio (Vp/Vw) of the volume of the colored resin solution (Vp) to the volume of the aqueous dispersion (Vw) should be $Vp/Vw \leqq 1$, preferably $0.3 \leqq Vp/Vw \leqq 0.7$.

Aqueous dispersions usable for preparation of an O/W type emulsion are those containing water and such a quantity of aqueous organic solvent as will not break down the emulsion, for example, a water/methanol mixed solution (weight ratio: 50/50 to 100/0), a water/ethanol mixed solution (weight ratio: 50/50 to 100/0), a water/acetone mixed solution (weight ratio: 50/50 to 100/0), and a water/methyl ethyl ketone mixed solution (weight ratio: 70/30 to 100/0).

It is desirable that some suitable dispersion stabilizer be added to such an aqueous medium. As such stabilizers, for example, the following may be enumerated: polyvinyl alcohol, gelatin, gum arabic, methyl cellulose, ethyl cellulose, methyl hydroxypropyl cellulose, sodium carboxymethylcellulose, sodium dodecylbenzene sulfonate, sodium octyl sulfonate, sodium laurylate, calcium phosphate, magnesium phosphate, aluminum phosphate, calcium carbonate, magnesium carbonate, barium sulfate, and bentonite. These dispersion stabilizers may be used within the range of from 0.05 to 3% by weight.

Any dispersion stabilizer may be supplementarily added in the course of dispersion of the colored resin solution or after the end of such dispersion. Such a supplementary addition of the dispersion stabilizeris effective for preventing agglomeration of droplets or deposits of resin particulate.

For improvement of dispersion stability of droplets, a dispersion stabilizing assistant may be used in combination with the dispersion stabilizer. Preferred dispersion stabilizing assistants are natural surface active agents including saponin, nonionic surface active agents, such as alkylene oxide-based, glycerin-based, and glycidol-based surface active agents, and anionic surface active agents containing acid groups, such as carboxylic acid, sulfonic acid, phosphoric acid, sulfate, and phosphate. More particularly, anionic surface active agents, such as sodium dodecylbenzene sulfonate and sodium lauryl sulfate, are preferred.

In the present invention, an O/W type emulsion is heated under stirring for eliminating non-aqueous organic solvents therefrom, whereby a suspension is obtained such that colored resin particles of specified particle size are dispersed in an aqueous medium. Thereafter, the aqueous medium is removed through filtration or otherwise for isolating colored resin particles. After having been washed, the colored resin particles are dried, and are classified as required, whereby toner particles can be obtained. Alternatively, an O/W type emulsion is sprayed in a dry atmosphere and any nonaqueous organic solvent in droplets is completely removed. In this way, colored resin fine particles can be obtained and, at the same time, the aqueous dispersion is removed by being allowed to evaporate. In case that a water-insoluble material, such as calcium phosphate is used as a dispersion stabilizer, such material can be removed by being dissolved by acid, e.g., hydrochloric acid.

The emulsified dispersion method has a characteristic feature that the method permits use of a larger variety of resins in contrast to the suspension polymerization method, for example. In the suspension polymerization method, polymerizable monomers are limited to vinyl monomers and, therefore, resulting resins are limited to vinyl resins. In contrast, the emulsified dispersion method permits the use of any resin which is soluble to some extent in a non-aqueous organic solvent. In the emulsified dispersion method, therefore, not only is it possible to use vinyl resins, but also it is possible to use, for example, polyester and epoxy resins which cannot be produced by the suspension polymerization method.

In the present invention, from the standpoint of fluidity improvement, it is desirable that 0.1 to 3% by weight of inorganic fine particles be externally added to the toner particles. Inorganic fine particles usable for this purpose are silica, titania, alumina, strontium titanate, tin oxide, and zinc oxide, which may be used in one kind alone or in combination of two or more kinds. From the view point of environment stability improvement, for such inorganic fine particles it is desirable to use those previously surface treated with a hydrophobicizing agent. In addition to such inorganic oxides, resin fine particles having a particle size of not more than 1 $\mu$m may be externally added.

The non-magnetic yellow toner of the present invention is preferably used in a non-magnetic mono-component development system of such a construction that, from the view point of size reduction of full-color image forming apparatus, a blade, i.e. a developer regulating member, is held in abutment against a developer supporting member, i.e., a development sleeve, and such that the toner is charged as it passes through the regulating section.

The invention will nowbe described more specifically with reference to various Examples. It is to be understood, however, that the invention is not limited to those Examples. Binder resins used in the following examples and comparative examples are as follows.

PREPARATION EXAMPLES OF POLYESTER RESINS 1–7

An alcohol component and an acid component in a molar ratio shown in Table 1 were introduced, together with a polymerization initiator (dibutyl tin oxide), into a four-mouthed glass flask fitted with a thermometer, an agitator, a flow-down type condenser, and a nitrogen introduction tube. The component materials were caused to react by heating them under stirring in a nitrogen atmosphere within a mantle heater. As a result, polyester resins 1–7 were obtained which respectively has such number-mean molecular weights (Mn), weight-mean molecular weight/number-mean molecular weight ratios (Mw/Mn), glass transition points (Tg), softening points (Tm), acid values, and hydroxyl values as shown in Table 1. In Table 1, PO denotes polyoxypropylene (2,2) -2,2-bis (4-hydroxyphenyl) propane; EO denotes polyoxyethylene (2,0) -2,2-bis (4-hydroxyphenyl) propane; GL denotes glycerin; TPA denotes terephthalic acid; TMA denotes trimellitic acid; and FA denotes fumaric acid.

TABLE 1

| Polyester | Alcohol Component | | | Acid Component | | | | | | | Acid | Hydroxyl |
|---|---|---|---|---|---|---|---|---|---|---|---|---|
| Resin | PO | EO | GO | FA | TPA | TMA | Mn | Mw/Mn | Tg | Tm | Value | Value |
| 1 | 4.0 | 6.0 | — | — | 9.0 | — | 3300 | 4.2 | 68.5 | 110.3 | 3.3 | 28.1 |
| 2 | 3.5 | 6.0 | 0.5 | — | 9.0 | — | 3400 | 4.5 | 64.8 | 115.2 | 4.9 | 23.0 |
| 3 | 5.0 | 5.0 | — | 5.0 | 4.0 | — | 3800 | 3.0 | 68.3 | 102.8 | 3.8 | 28.7 |
| 4 | 3.0 | 7.0 | — | — | 7.0 | 2.0 | 2800 | 2.3 | 59.5 | 101.8 | 1.3 | 60.4 |
| 5 | 2.5 | 7.5 | — | 7.5 | 5.0 | — | 5200 | 4.3 | 61.0 | 99.5 | 24.9 | 19.1 |
| 6 | 3.0 | 7.0 | — | — | 9.0 | 1.0 | 3900 | 3.1 | 61.9 | 101.4 | 0.8 | 36.2 |
| 7 | 9.0 | — | — | 10.0 | 4.0 | 1.5 | 4800 | 3.2 | 59.1 | 108.6 | 35.1 | 22.8 |

Molecular weight measurement was made by using a gel permeation chromatography (807-IT type; made by Nihon Bunko Kogyo K. K.), with tetrahydrofuran used as a carrier solvent. Measurements were expressed in terms of polystyrene.

Measurement of the glass transition point was made with respect to 10 mg of sample weighed using a differential scanning calorimeter (DSC-200; Seiko Denshi K. K.) and, with alumina used as a reference, a shoulder value of main endothermic peak within a temperature range of 30 to 80° C. was taken as the glass transition point.

For the softening point, measurement was made with respect to 1.0 g of sample by using a flow tester (CFT-500; Shimadzu Seisakusho K. K.) and a die of 1.0 mm×1.0 mm under the conditions of: temperature rise, 3.0° C.; and load applied, 30 kg. The temperature at which efflux of one half of the sample occurred was taken as softening point.

Acid value measurement was made by dissolving a weighed sample in a suitable solvent, with phenol phthalein used as an indicator. Acid values were expressed in mg terms of potassium hydroxide requirement for neutralizing acid groups.

Hydroxyl value measurement was made by hydrolyzing an acetylated product obtained by treating a weighed sample with acetic anhydride. Measured values were expressed in mg terms of potassium hydroxide requirement for neutralizing liberated acetic acid.

PREPARATION OF PIGMENT MASTER BATCHES 1–7

Polyester resin 1 and yellow pigment (C.I. pigment yellow 180) were charged into a pressure kneader in a resin to pigment ratio of 7:3 and the materials were kneaded. The kneaded mixture was cooled and was then pulverized in a feather mill. As a result, a pigment master batch 1 was obtained. Pigment master batches 2–7 were obtained in the same way except that polyester resins 2–7 were respectively used in place of polyester resin 1.

EXAMPLE 1

Ninety three parts by weight of polyester resin 1, 10 parts by weight of pigment master batch 1, 2 parts by weight of zinc complex salicylate (E-81; made by Orient Kagaku Kogyo K. K.), and 1 part by weight of oxydized type low molecular weight polypropylene (100TS; Sanyo Kasei K. K.; softening point, 140° C.; acid value, 3.5 KOHmg/g) were thoroughly mixed in a Henschel mixer, and then the mixture was kneaded in a twin-screw extruder-kneader (PCM-30; made by Ikegai Tekko K. K.), with the discharge port removed therefrom. The kneaded mixture, after having been cooled, was primarily crushed in a feather mill. Then, the crushed mixture was pulverized in an Inomizer (INM-30; made by Hosokawa Micron K. K.), and the pulverized mixture was minutely classified by a rotor classifier (Teeplex classifier, type 100ATP; made by Hosokawa Micron K. K.). As a result, toner particles were obtained which had a volume mean particle size of 6.2 $\mu$m and included 0.1% by weight of toner particles having a particle size of not less than two times the volume mean particle size thereof, and 3.8% by number of toner particles having a particle size of not more than one third of the volume mean particle size. The roundness of the toner particles was 0.953, and the standard deviation of their roundness was 0.036.

To 100 parts by weight of toner particles thus obtained were added 0.5 part by weight of a hydrophobic silica (TS-500; made by Cabosil Co. LTD K. K.) and 1.0 part by weight of hydrophobic titanium dioxide (STT30A; made by Titan Kogyo K. K.), and mixing was carried out in a Henschel mixer. Thus, yellow toner 1 was obtained.

EXAMPLES 2–5

Yellow toners 2–5 were obtained in the same way as in Example 1, except that polyester resins 2–5 were respectively used instead of polyester resin 1, and that pigment master batches 2–5 were respectively used instead of the pigment master batch 1.

EXAMPLE 6

Yellow toner 6 was obtained in the same was as in Example 2, except that the addition of oxydized type low-molecular weight polypropylene was changed to 2 parts by weight.

EXAMPLE 7

Yellow toner 7 was obtained in the same way as in Example 6, except that the toner particles obtained in Example 6 were treated by a surface treatment apparatus (hybridization system NHS-3; made by Nara Kikai Seisakusho K. K.) at 6000 rpm for 5 minutes.

COMPARATIVE EXAMPLE 1

Yellow toner 8 was obtained in the same way as in Example 2, except that pulverization was carried out by using a jet crusher (ADZE; made by Nippon Pneumatic K. K.) instead of the inomizer as a means for pulverizing the coarsely ground material and that a DS classifier (made by Nippon Pneumatic K. K.) was used instead of the rotor classifier for minute classification purposes, and except that the volume mean particle size of the toner was conditioned to 9.4 μm.

COMPARATIVE EXAMPLE 2

Yellow toner 9 was obtained in the same way as in Example 2, except that pulverization was carried out by using a jet crusher (ADZE; made by Nippon Pneumatic K. K.) instead of the inomizer as a means for pulverizing the coarsely ground material and that a DS classifier (made by Nippon Pneumatic K. K.) was used instead of the rotor classifier for minute classification purposes.

COMPARATIVE EXAMPLE 3

Yellow toner 10 was obtained in the same way as in Example 1, except that polyester resin 1 was changed to polyester resin 6 and that pigment master batch 1 was changed to pigment master batch 6.

COMPARATIVE EXAMPLE 4

Yellow toner 11 was obtained in the same way as in Example 1, except that polyester resin 1 was changed to polyester resin 7 and that pigment master batch 1 was changed to pigment master batch 7.

COMPARATIVE EXAMPLE 5

Yellow toner 12 was obtained in the same way as in Example 4, except that C. I. pigment yellow 180 was changed to C. I. solvent yellow 19.

COMPARATIVE EXAMPLE 6

Yellow toner 13 was obtained in the same way as in Example 1, except that C. I. pigment yellow 180 was changed to C. I. pigment yellow 133.

COMPARATIVE EXAMPLE 7

Yellow toner 14 was obtained in the same way as in Example 1, except that C. I. pigment yellow 180 was changed to C. I. pigment yellow 169.

COMPARATIVE EXAMPLE 8

Yellow toner 15 was obtained in the same way as in Example 1, except that C. I. pigment yellow 180 was changed to C. I. pigment yellow 62.

COMPARATIVE EXAMPLE 9

In Example 2, a jet crusher (ADZE; made by Nippon Pneumatic K. K.) was used instead of "Inomizer" as a means for pulverizing coarse particles, and the pulverized material was heat treated by a heat treatment apparatus (made by Hosokawa Micron K. K.) at 108° C. for being formed into a spherical shape. Subsequently, coarse particles and dust-size particles were eliminated by using an "Elbow" jet classifier (made by Nittetsu Kogyo K. K.) and toner particles were thus obtained.

To 100 parts by weight of toner particles thus obtained were added 0.5 part by weight of a hydrophobic silica (TS-500; made by Cabosil Co. LTD K. K.) and 1.0 part by weight of hydrophobic titanium dioxide (STT30A; made by Titan Kogyo K. K.), and mixing was carried out in a Henschel mixer. Thus, yellow toner 16 was obtained.

With respect to toners 1–16 obtained in the foregoing Examples 1–7 and Comparative Examples 1–9, volume mean particle size ($D_{50}$; μm), toner particle content (wt %) having a particle size of not less than two times the volume mean particle size ($\geqq 2D_{50}$), toner particle content (number %) having a particle size of not more than one third of the volume mean particle size ($\leqq D_{50}/3$), and mean roundness and roundness standard deviations of toner particles are shown in Table 2.

TABLE 2

| | Toner | $D_{50}$ (μm) | $>2D_{50}$ (Wt %) | $<D_{50}/3$ (Number %) | Mean Roundness | Standard Roundness Deviation |
|---|---|---|---|---|---|---|
| Ex. 1 | 1 | 6.2 | 0.1 | 3.8 | 0.0953 | 0.036 |
| Ex. 2 | 2 | 6.1 | 0.1 | 3.7 | 0.0953 | 0.037 |
| EX. 3 | 3 | 6.1 | 0.1 | 3.6 | 0.0954 | 0.035 |
| Ex. 4 | 4 | 5.9 | 0.1 | 3.2 | 0.0960 | 0.038 |
| Ex. 5 | 5 | 5.8 | 0.1 | 3.4 | 0.0955 | 0.037 |
| Ex. 6 | 6 | 6.0 | 0.1 | 2.8 | 0.0957 | 0.036 |
| Ex. 7 | 7 | 6.0 | 0.1 | 2.7 | 0.0968 | 0.027 |
| Comp. Ex. 1 | 8 | 9.4 | 0.3 | 8.6 | 0.0938 | 0.053 |
| Comp. Ex. 2 | 9 | 6.1 | 2.2 | 10.0 | 0.0935 | 0.054 |
| Comp. Ex. 3 | 10 | 6.3 | 0.1 | 3.8 | 0.0952 | 0.035 |
| Comp. Ex. 4 | 11 | 6.1 | 0.1 | 3.5 | 0.0952 | 0.036 |
| Comp. Ex. 5 | 12 | 6.3 | 0.1 | 3.8 | 0.0953 | 0.036 |
| Comp. Ex. 6 | 13 | 6.2 | 0.1 | 3.2 | 0.0952 | 0.034 |
| Comp. Ex. 7 | 14 | 6.0 | 0.1 | 3.9 | 0.0953 | 0.032 |
| Comp. Ex. 8 | 15 | 7.0 | 0.1 | 3.6 | 0.0952 | 0.038 |
| Comp. Ex. 9 | 16 | 7.4 | 1.8 | 2.0 | 0.0951 | 0.050 |

PREPARATION OF CYAN TONER, MAGENTA TONER, AND BLACK TONER

A cyan toner was obtained in the same way as in Example 2, except that C. I. pigment-yellow 180 was changed to C. I. pigment blue 15–3. The cyan toner particles had a volume mean particle size of 6.2 μm and included 0.1% by weight of toner particles having a particle size of not less than two times the volume mean particle size thereof, and 2.9% by number of toner particles having a particle size of not more than one third of the volume mean particle size. The roundness of the toner particles was 0.956, and the standard deviation of their roundness was 0.035.

Amagerta toner was obtained in the same way as in Example 2, except that C. I. pigment yellow 180 was changed to C. I. pigment red 184. The magenta toner particles had avolume mean particle size of 6.2 μm and included 0.1% by weight of toner particles having a particle size of not less than two times the volume mean particle size thereof, and 3.2% by number of toner particles having a particle size of not more than one third of the volume mean particle size. The roundness of the toner particles was 0.955, and the standard deviation of their roundness was 0.036.

A black toner was obtained in the same way as in Example 2, except that C. I. pigment yellow 180 was changed to 5 parts by weight of carbon black ("Mogul L"; made by Cabot K. K.). The black toner particles had a volume mean particle size of 6.4 $\mu$m and included 0.1% by weight of tonerparticles having a particle size of not less than two times the volume mean particle size thereof, and 2.3% by number of toner particles having a particle size of not more than one third of the volume mean particle size. The roundness of the toner particles was 0.959, and the standard deviation of their roundness was 0.037.

Toners of above given Examples and Comparative Examples were evaluated in various respects and the results are shown in Table 3.

OHP PERMEABILITY AND COLOR REPRODUCIBILITY OF IMAGES HAVING DIFFERENT DOT AREA PERCENTAGES

By using a full-color printer to be hereinafter described, images with dot area percentages of 100%, 50%, and 20% were reproduced on an OHP sheet through a 150 line screen in an ordinary temperature/ordinary moisture environment (25° C., 60% RH). Respective images were visually evaluated in respect of yellow color development when the images were projected by an overhead projector. Where color development was found clear, the toner was rated ○; where color development was only slight, the toner was rated Δ; and where no color development was observed, the toner was rated x.

The full-color printer employed for the purpose of this evaluation is of such a construction as shown in FIG. 1, and includes an organic photosensitive drum 10 (hereinafter referred to as "photosensitive member 10") driven to rotate in the direction of arrow a in the drawing, a laser scan optical system 20, a full-color developing assembly 30, an endless intermediate transfer belt 40 driven to rotate in the direction of arrow b in the drawing, and a sheet feeder portion 60. Around the photosensitive member 10 there are provided a charging brush 11 for charging the surface of the photosensitive member 10 to a predetermined potential, and a cleaner 12 for removing any toner residue present on the photosensitive member 10.

The laser scan optical system 20 is a well-known system incorporating a laser diode, a polygon mirror, and an fθ optical element, and has a controller to which print data for cyan (C), magenta (M), yellow (Y), and black (BK) are transmitted from the host computer. The laser scan optical system 20 sequentially output print data for each respective color in the form of laser beam and scan over the photosensitive member 10 for exposure, whereby electrostatic latent images for respective colors are sequentially formed on the photosensitive member 10.

The full-color developing assembly 30 is an integral assembly of four separate color developing units 31C, 31M, 31Y and 31BK toners, and is rotatable clockwise about a support shaft 33. Each color developing unit includes a developing sleeve 32, toner regulator blades 34*a* and 34*b*. Toner particles transported through the rotation of the developing sleeve 32 are charged by their passing through a pressure contact portion (regulator portion) between the blades 34*a*, 34*b* and the developing sleeve 32.

The intermediate transfer belt 40 is driven to rotate synchronously with the photosensitive member 10 in the direction of the arrow b shown in the drawing. The intermediate transfer belt 40 is pressed by a freely rotatable first transfer roller 41 into contact with the photosensitive member 10. The portion for this contact is a first transfer section $T_1$. The intermediate transfer belt 40 is in contact with a freely rotatable second transfer roller 43 at a portion supported by a support roller 42. The portion for this contact is a second transfer section $T_2$.

A cleaner 50 is disposed in a space between the developing assembly 30 and the intermediate transfer belt 40. The cleaner 50 has a blade for removing any toner residue on the intermediate transfer belt 40. The blade and the second transfer roller 43 are movable toward and away from the intermediate transfer belt 40.

The sheet feeder portion 60 includes a feed tray 61 adapted to be open on the front side of the image forming apparatus 1, a feed roller 62, and a timing roller 63. Recording sheets S, loaded on the feeder tray 61, are fed one by one rightward in the drawing through the rotation of the feed roller 62 and are delivered by the timing roller 63 toward the second transfer section $T_2$ in synchronous relation with an image formed on the intermediate transfer belt 40. A horizontal transport path for recording sheets comprises an air suction belt 66 and the like, including the sheet feeder portion, and a vertical transport path 80 equipped with transfer rollers extends from a fixing unit 70. Each recording sheet S is discharged from the vertical transport path 80 onto the top surface of the image forming apparatus body 1.

In this conjunction printing operation of the full-color printer will be explained. When printing operation begins, the photosensitive member 10 and the intermediate transfer belt 40 are driven to rotate at an equal peripheral speed, and the photosensitive member 10 is charged by the charging brush 11 to a predetermined potential.

Subsequently, a cyan image is exposed by the laser scan optical system 20 so that an electrostatic latent image of the cyan image is formed on the photoserniitive member 10. The electrostatic latent image is immediately developed at developing unit 31C. and a toner image is transferred onto the intermediate transfer belt 40 at the first transfer section $T_1$. Immediately upon the completion of the first transfer, developing unit 31M is switched over to the developing section D, followed by exposure, development, and first transfer. Then, switching over to developing unit 31Y is carried out, followed by exposure, development and first transfer with respect to magenta image. Then, switching over to developing unit 31Y is carried out, followed by exposure, development, and first transfer with respect to yellow image. Again, switching over to developing unit 31BK is carried out, followed by exposure, development, and first transfer with respect to black image. Each time when a first transfer is made, a toner image is placed on the intermediate transfer belt 40 in superposed relation to a previously placed toner image.

Upon completion of a final first transfer, recording sheet S is delivered to a second transfer section $T_2$, and a full-color toner image formed on the intermediate transfer belt 40 is transferred onto the recording sheet S. Upon completion of the second transfer, recording sheet S is transported to a belt-type heat fixing device 70, and a full-color toner is fixed on the recording sheet S, which is in turn discharged onto the upper surface of the printer body 1.

Above described image formation was carried out under preset conditions of: toner deposit 0.7 mg/cm$^2$ on a solid image portion of the recording sheet, with a surface potential of −550 V at the photosensitive member, a development bias voltage of −200 V, aprimary transfer bias voltage of 900 V, and a secondary transfer vias voltage of 500 V taken as standards, and under fixing temperature conditions of 160° C. With respect to below mentioned aspects of fogging, image break, transferability, and dot reproducibility, evaluation was made in a low temperature, low humidity environment (10° C., 15% RH) and also in a high temperature, high humidity environment (30° C., 85% RH). Unfavorable evaluation results only are shown in Table 3.

Fogging

Character patterns having a B/W ratio of 5% were printed in a single color of yellow toner only by employing above described full-color printer, and images obtained were each visually examined. Where little or no fog was found, the toner was rated ○; where slight fog was found but not objectionable from the practical point of view, the toner was rated Δ; and where fogging was found all over and objectionable from the view point of practical use, the toner was rated X.

Image Break

Character "E" was printed in green color, a color formed from yellow and cyan toners place one over the other, by employing the full-color printer. Where no image break was found with respect to the character "E", the toner was rated ○; where some image break was found with respect to the character "E", but the character "E" in green color could be recognized, posing no problem from the view point of practical use, the toner was rated Δ; and where image break was so serious that the green color character "E" was difficult to recognize, the toner was rated X.

Transferability

With respect to images printed in a single color of yellow toner only by employing the full-color printer, the ratio of toner deposit on the transfer sheet to the toner deposit on the photosensitive drum was measured. Where the ratio was 80% or more, the toner was rated ○; where the ratio was not less than 70% but less than 80%, the toner was rated Δ; and where the ratio was less than 70%, the toner was rate X.

Dot Reproducibility 600 dpi, 2-dot images were printed and dots therein were observed by means of a magnifier (50×). Where dots were each well reproduced with few, if any, dot size variations found, the toner was rated ○; where dot size variations were found considerable, the toner was rated Δ; and where dots were each defective or were held in adhesion one to another, or were not sufficiently reproduced, the oner was rated X.

Resistance to Light

Images printed in a single color of yellow toner only by employing the full-color printer were subjected to UV-light irradiation by a UV-light irradiating apparatus for 30 minutes. Where no color fading was observed, the toner was rated ○; where some fading was found but not objectionable from the view point of practical use, the toner was rated Δ; and where considerable color fading was observed, the toner was rated X.

Heat Resistance

Five g of toner, put in a 50 cc glass bottle, was allowed to stand at 55° C. for 24 hours. The toner was examined in respect of toner agglomeration. Where no agglomeration was observed, the toner was rated ○; where some agglomerates were present but could be easily separated by external force, the toner was rated Δ; and where agglomerates were present which could not easily be separated by external force, the toner was rated X.

TABLE 3

| | OHP Permeability & Color Reproducibility | | | Image | | | Dot | Light | Heat |
|---|---|---|---|---|---|---|---|---|---|
| | 100% | 50% | 20% | Fog | Break | Transferability | Reproducibility | Resistance | Resistance |
| Ex. 1 | ○ | ○ | ○ | ○ | ○ | ○ | ○ | ○ | ○ |
| Ex. 2 | ○ | ○ | ○ | ○ | ○ | ○ | ○ | ○ | ○ |
| Ex. 3 | ○ | ○ | ○ | ○ | ○ | ○ | ○ | ○ | ○ |
| Ex. 4 | ○ | ○ | ○ | ○ | ○ | ○ | ○ | ○ | ○ |
| Ex. 5 | ○ | ○ | ○ | ○ | ○ | ○ | ○ | ○ | ○ |
| Ex. 6 | ○ | ○ | ○ | ○ | ○ | ○ | ○ | ○ | ○ |
| Ex. 7 | ○ | ○ | ○ | ○ | ○ | ○ | ○ | ○ | ○ |
| Comp. Ex. 1 | ○ | ○ | ○ | Δ | Δ | ○ | x | ○ | ○ |
| Comp. Ex. 2 | ○ | ○ | ○ | x | x | Δ | Δ | ○ | Δ |
| Comp. Ex. 3 | ○ | ○ | Δ | x | x | Δ | Δ | ○ | ○ |
| Comp. Ex. 4 | ○ | ○ | ○ | x | x | Δ | Δ | ○ | ○ |
| Comp. Ex. 5 | ○ | ○ | ○ | x | Δ | Δ | ○ | x | x |
| Comp. Ex. 6 | ○ | Δ | x | Δ | Δ | Δ | ○ | Δ | ○ |
| Comp. Ex. 7 | ○ | Δ | x | Δ | Δ | Δ | ○ | Δ | ○ |
| Comp. Ex. 8 | ○ | Δ | x | Δ | Δ | Δ | ○ | Δ | ○ |
| Comp. Ex. 9 | ○ | ○ | ○ | x | Δ | Δ | x | ○ | Δ |

With respect to yellow toner 6 obtained in Example 6 and cyan, magenta, and black toners obtained in the foregoing Preparation Examples, 3000-sheet voluminous printing tests were carried out using aforesaid full-color printer with a full-color image having a B/W ratio of 6%. At the end of the voluminous printing test, the image was examined for evaluation of fogging, image break, and transferability. All the toners maintained ○ rank.

EXAMPLE 8

Ninty three parts by weight of polyester resin, 10 parts by weight of pigment master batch 1, 1 part by weight of a boron compound expressed by the following formula (A), and 400 parts by weight of toluene were mixed together for 30 minutes by using a supersonic homogenizer (output 400

μA). The mixture was then dissolved and dispersed. Thus, a colored resin solution was prepared.

(A)

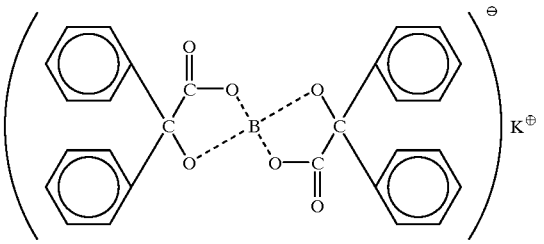

Whilst, 0.1 part by weight of sodium lauryl sulfate (made by Wako Junyaku K. K.) was dissolved in 1000 parts by weight of an aqueous solution containing 4% by weight of calcium phosphohydroxide as a dispersion stabilizer, whereby an aqueous dispersion was prepared.

One hundred parts by weight of aforesaid aqueous dispersion were agitated in a TK homomixer (made by Tokushu Kika Kogyo K. K.) at 4000 rpm, and 50 parts by weight of the colored resin solution were introduced dropwise into the aqueous dispersion, so that droplets of the resin solution were suspended in the aqueous dispersion. The suspension was allowed to stand for 5 hours under the conditions of 60° C. and 100 mmHg, whereby toluene was removed from the droplets and the colored resin fine particles were precipitated. Next, the calcium phosphohydroxide was dissolved by concentrated hydrochloric acid and then filtration and washing were repetitively carried out.

Thereafter, the colored resin particles were dried at 80° C. by a slurry drying apparatus ("Dispacoat"; made by Nisshin Engineering K. K.) and thus yellow toner particles were obtained. To 100 parts by weight of the yellow toner particles were added 0.5 part by weight of hydrophobic silica (TS-500, made by Cabosil Co. LTD K. K.) and 1.0 part by weight of hydrophobic titanium dioxide (STT-30A; made by Titan Kogyo K. K.). and the materials were mixed together to give yellow toner 17.

EXAMPLES 9–12

Yellow toners 18–21 were obtained in the same way as in Example 8, except that polyester resin 1 was changed to polyester resin 2–5 and except that pigment master batch 1 was changed to pigment master batch 2–5.

EXAMPLE 13

Yellow toner 22 was obtained in the same way as in Example 8, except that 1 part by weight of an oxydized type low molecular weight polypropylene wax (100TS; made by Sanyo Kasei Kogyo K. K.; softening point, 140° C.; acid value, 3.5 KOHmg/g) was added for conditioning the colored resin solution.

EXAMPLE 14

Ninety three parts by weight of polyester resin 2, 10 parts by weight of pigment master batch 2, and 2 parts by weight of zinc complex salicylate (E-84; made by Orient Kagaku Kogyo K. K.) were thoroughly mixed. The mixture was then kneaded in a three-roll mill heated to 140° C. The kneaded mixture was allowed to stand and cool, and was then subjected to coarse grinding in a feather mill. One hundred parts by weight of the coarse particles and 400 parts by weight of a methylene chloride/toluene (8/2) mixture solvent were mixed together, dissolved and dispersed. Thus, a colored resin solution (dispersed phase) was obtained. Next, an aqueous dispersion (continuous phase) was prepared such that 60 parts by weight of a 4% aqueous solution of methyl cellulose (Metocell K35LV; made by Dow Chemical K. K.), as a dispersion stabilizer, 5 parts by weight of a 1% aqueous solution of sodium dioctyl sulfosuccinate (Nikkole OTP 75; made by Nikko Chemical K. K.), and 0.5 part by weight of sodium hexamethaphosphate (made by Wako Junyaku K. K.) were dissolved in 1000 parts by weight of ion-exchanged water.

Figure 4:
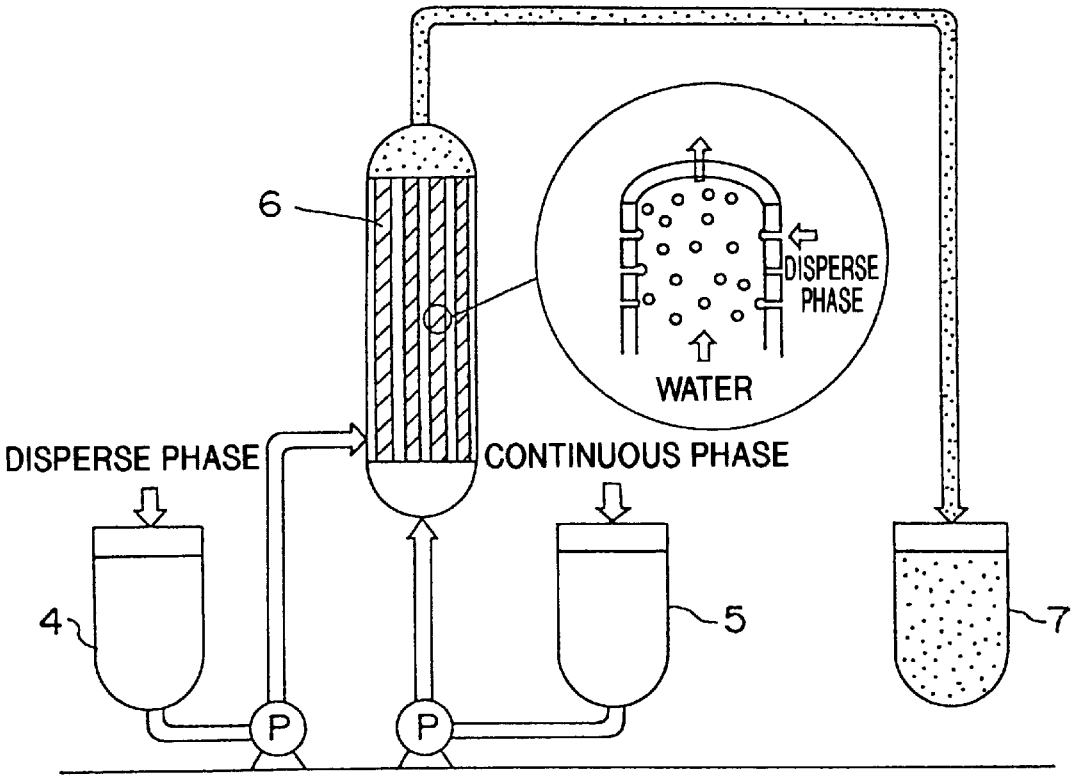
FIG. 4 is a view showing a schematic construction of an apparatus for forming an emulsion using a micro-porous material.

As a microporous structure was used a $CaO—B_2O_3—SiO_2—Al_2O_3$ based porous glass such that in a relative pore ogive with respect to pores of the microporous structure, "pore diameter (ϕ10) in the case where cumulative pore volume formed 10% of the total pore volume" divided by "pore diameter (ϕ90) in the case where cumulative pore volume formed 90% of the total pore volume", that is, the quotient ϵ(ϕ10/ϕ90) was 1.2, and such that mean pore diameter was 2.0 μm. A colored resin solution (disperse phase) was injected through the microporous structure into the aqueous dispersion (continuous phase) by using the apparatus shown in FIG. 4. An O/W type emulsion was thus prepared. In FIG. 4, the disperse phase is continuously injected by pump P from tank 4 into microporous structure 6, and is mixed with a continuous phase supplied continuously from tank 5 to the interior of the microporous structure 6 so that an emulsion is formed. The emulsion formed in this way is transported to emulsion tank 7.

Subsequently, the solution in the emulsion tank 7 was taken out and, in an agitation tank, the solution was agitated while the temperature of the system was kept at 50° C., so that the methylene chloride/toluene mixed solvent was eliminated and so that colored resin fine particles were precipitated. Then, filtration and washing were repetitively carried out. Thereafter, the step of drying the colored resin particles was carried out at 80° C. by using a slurry drying apparatus ("Dispacoat", made by Nisshin Engineering K. K.), and thus yellow toner particles were obtained.

To 100 parts by weight of the yellow toner particles were added 0.5 part by weight of hydrophobic silica (TS-500; made by Cabosil Co. LTD K. K.) and 1.0 part by weight of hydrophobic titanium dioxide (STT-30A; made by Titan Kogyo K. K.), which were mixed together in a Henschel mixer. Thus, yellow toner 23 was obtained.

COMPARATIVE EXAMPLE 10

Yellow toner 24 was obtained in the same way as in Example 11, except that C. I. pigment yellow 180 was changed to C. I. solvent yellow 19.

COMPARATIVE EXAMPLE 11

Yellow toner 25 was obtained in the same way as in Example 8, except that C. I. pigment yellow 180 was changed to C. I. pigment yellow 133.

COMPARATIVE EXAMPLE 12

Yellow toner 26 was obtained in the same way as in Example 8, except that C. I. pigment yellow 180 was changed to C. I. pigment yellow 169.

COMPARATIVE EXAMPLE 13

Yellow toner 27 was obtained in the same way as in Example 8, except that C. I. pigment yellow 180 was changed to C. I. pigment yellow 62.

With respect to toners 17–27 obtained in the foregoing Examples 8–14 and Comparative Examples 10–13, volume mean particle size ($D_{50}$), toner particle content in weight % having not less than two times the volume mean particle size ($\geqq 2D_{50}$), toner particle content in number % having not more than one third of the volume mean particle size ($\leqq D_{50}/3$), toner particle mean roundness, and roundness standard deviation are shown in Table 4.

TABLE 4

| | Toner | $D_{50}$ ($\mu$m) | $\geqq 2D_{50}$ (Wt %) | $\leqq D_{50}/3$ (Number %) | Mean Roundness | Standard Roundness Deviation |
|---|---|---|---|---|---|---|
| Ex. 8 | 17 | 6.0 | 0.1 | 3.1 | 0.0991 | 0.026 |
| Ex. 9 | 18 | 6.1 | 0.1 | 2.8 | 0.0991 | 0.023 |
| EX. 10 | 19 | 6.0 | 0.2 | 2.7 | 0.0990 | 0.023 |
| Ex. 11 | 20 | 5.9 | 0.1 | 3.0 | 0.0991 | 0.024 |
| Ex. 12 | 21 | 6.1 | 0.1 | 2.9 | 0.0990 | 0.024 |
| Ex. 13 | 22 | 6.4 | 0.3 | 2.3 | 0.0989 | 0.030 |
| Ex. 14 | 23 | 6.0 | 0 | 0.3 | 0.0994 | 0.019 |
| Comp. Ex. 10 | 24 | 6.3 | 0.8 | 5.1 | 0.0981 | 0.031 |
| Comp. Ex. 11 | 25 | 6.5 | 0.6 | 5.3 | 0.0943 | 0.042 |
| Comp. Ex. 12 | 26 | 6.4 | 2.2 | 5.0 | 0.0937 | 0.048 |
| Comp. Ex. 13 | 27 | 6.2 | 1.7 | 5.4 | 0.0941 | 0.046 |

PREPARATION OF CYAN TONER AND MAGENTA TONER

A cyan toner was obtained in the same way as in Example 13, except that C. I. pigment yellow 180 was changed to C. I. pigment blue 15–3. The cyan toner particles had a volume mean particle size of 6.2 $\mu$m and included 0.4% by weight of toner particles having a particle size of not less than two times the volume mean particle size thereof, and 2.7% by number of toner particles having a particle size of not more than one third of the volume mean particle size. The roundness of the toner particles was 0.988, and the standard deviation of their roundness was 0.031.

Amagenta toner was obtained in the same way as in Example 13, except that C. I. pigment yellow 180 was changed to C. I. pigment red 184. The magenta toner particles had a volume mean particle size of 6.3 $\mu$m and included 0.4% by weight of toner particles having a particle size of not less than two times the volume mean particle size thereof, and 3.4% by number of toner particles having a particle size of not more than one third of the volume mean particle size. The roundness of the toner particles was 0.986, and the standard deviation of their roundness was 0.033.

PREPARATION OF BLACK TONER

Into a flask equipped with an agitator, an inert gas introduction pipe, a reflux condenser, and a thermometer were introduced 200 parts by weight of deionized water with 0.1 part by weight of vinyl alcohol dissolved, and a mixture such that 8 parts by weight of benzoyl peroxide was dissolved in a polymerizable monomer composed of 98 parts by weight of styrene and 2 parts by weight of isopropenyl oxazoline. Agitation was carried out at high speed to provide a homogeneous suspension. Then, the content was heated to 80° C. in a nitrogen gas atmosphere and was caused to go into polymerization reaction under stirring for 5 hours. After polymerization reaction, the content was cooled to provide a polymer suspension. Filtration and washing were repetitively carried out and, as a result, a polymer having an oxazoline group as a reactive group was obtained. Forty parts by weight of the polymer thus obtained and 20 parts by weight of carbon black (MA-100S; made by Mitsubishi Kagaku K. K.; pH 3.2) were kneaded at 170° C. by using a 3-roll assembly. After having been cooled, the kneaded material was pulverized in a feather mill and thus a carbon black graft polymer was obtained.

A black toner was obtained in the same way as in Example 13, except that 93 parts by weight of polyester resin 1 and 10 parts by weight of pigment master batch 1 were changed respectively to 86 parts by weight of polyester resin 1 and 14 parts by weight of carbon black graft polymer 14. The black toner particles had a volume mean particle size of 6.5 $\mu$m and included 0.5% by weight of toner particles having a particle size of not less than two times the volume mean particle size thereof, and 3.7% by number of toner particles having a particle size of not more than one third of the volume mean particle size. The roundness of the toner particles was 0.981, and the standard deviation of their roundness was 0.035.

The above mentioned toners were evaluated in the same way as in the case of toners 1–16. Evaluation results are shown in Table 5.

TABLE 5

| | OHP Permeability & Color Reproducibility | | | Image | | | Dot | Light | Heat |
|---|---|---|---|---|---|---|---|---|---|
| | 100% | 50% | 20% | Fog | Break | Transferability | Reproducibility | Resistance | Resistance |
| Ex. 8 | ○ | ○ | ○ | ○ | ○ | ○ | ○ | ○ | ○ |
| Ex. 9 | ○ | ○ | ○ | ○ | ○ | ○ | ○ | ○ | ○ |
| Ex. 10 | ○ | ○ | ○ | ○ | ○ | ○ | ○ | ○ | ○ |
| Ex. 11 | ○ | ○ | ○ | ○ | ○ | ○ | ○ | ○ | ○ |
| Ex. 12 | ○ | ○ | ○ | ○ | ○ | ○ | ○ | ○ | ○ |
| Ex. 13 | ○ | ○ | ○ | ○ | ○ | ○ | ○ | ○ | ○ |
| Ex. 14 | ○ | ○ | ○ | ○ | ○ | ○ | ○ | ○ | ○ |
| Comp. Ex. 10 | ○ | ○ | ○ | Δ | ○ | ○ | ○ | x | x |
| Comp. Ex. 11 | ○ | Δ | x | Δ | Δ | Δ | Δ | Δ | ○ |
| Comp. Ex. 12 | ○ | Δ | x | x | x | x | x | Δ | ○ |
| Comp. Ex. 13 | ○ | Δ | x | x | x | x | x | Δ | ○ |

With respect to yellow toner 22 obtained in Example 13, and cyan, magenta and black toners obtained in the foregoing preparation examples, voluminous printing tests were carried out of full-color images having a B/W ratio of 6% in the quantity of 3,000 sheets each by using above described full-color printer. After completion of the voluminous printing, the printed images were examined for toner evaluation in respect of fogging, image break, and transferability. The tests witnessed that the toners all maintained ○ rank.

EXAMPLE OF CARRIER PREPARATION

One hundred parts by weight of bisphenol A polyester resin having an acid value of 2 KOHmg/g and a glass transition point of 60° C., 400 parts by weight of magnetic powder (EPT-1000; made by Toda Kogyo K. K.), 5 parts by weight of carbon black (Ketchen Black EC; made by Lion Yushi K. K.) and 2 parts by weight of silica (H2000; made by Hoechst K. K.) were thoroughly mixed in a Henschel mixer. The mixture was then melt-kneaded in a twin-screw extruder-kneader. The kneaded mixture, after being cooled, was crushed into coarse particles in a feather mill, and the resulting coarse particles were minutely pulverized in a jet mill. Thereafter, the particles were classified by an air classifier, followed by heat treatment at 300° C. by a Surfusing System (SFS-1 type; made by Nihon Pneumatic K. K.). As a result, a carrier having a volume-mean particle size of 35 $\mu$m was obtained.

Figure 5:
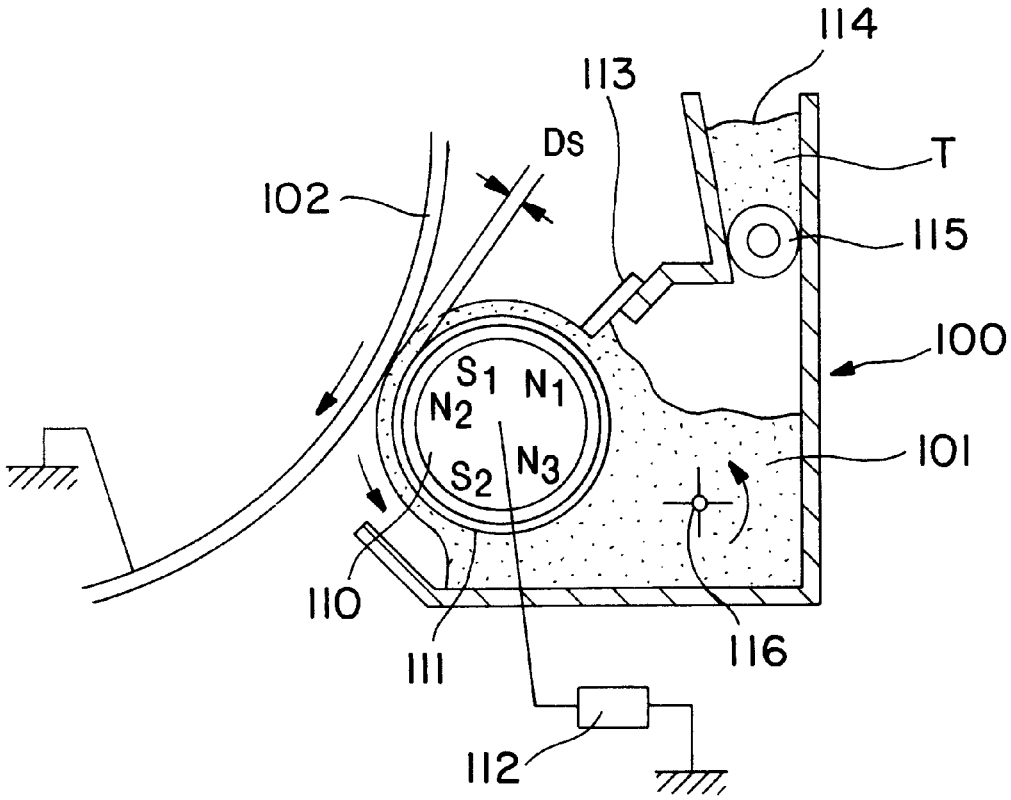
FIG. 5 is a schematic explanatory view of a two-component developing apparatus.

Then, by using the development apparatus shown in FIG. 5, experiments were made with respect to the yellow developing agent of the invention for use as a two-component developing agent. The developing agent was a yellow developing agent composed of the yellow toner 18 and the carrier obtained in the foregoing preparation example such that the toner and carrier were mixed to provide a toner concentration of 7% by weight.

In the FIG. 5 developing apparatus 100, reversal development was carried out under the conditions: quantity of developing agent transported to the developing region, 4.5 mg/cm$^2$, Ds 0.35 mm; peripheral speed of the photosensitive member 102, 120 mm/sec; and peripheral speed of the development sleeve 111, 300 mm/sec; and surface potential of the photosensitive member, −450 v, and under development bias conditions where a DC voltage pf −350 V from development bias supply 112, and an AC voltage having a peak-peak voltage of 1.4 KV, a frequency of 3 KHz short wave, with a duty ratio of 1:1 (development:collection), were combined in superposed relation. Voluminous imaging was carried out in the quantity of 10,000 sheets by using the yellow developing agent. After the voluminous printing, initial and post-printing images formed were evaluated in respect of density unevenness and fogging. All the images were found free of density unevenness and fogging.

The arrangement of the FIG. 5 development apparatus, employed in aforesaid evaluation will be briefly explained. The development apparatus 100 houses therein a developing agent 101 comprising toner T and a carrier, and includes a developer transport member for transporting the developing agent, that is, a cylindrical development sleeve 111 in which a magnet roller 110 having plural magnetic poles are fixedly arranged, the development sleeve 111 is so arranged that it is positioned in opposed relation to a negatively chargeable organic photosensitive member 102 with a suitable space D from the photosensitive member 102.

The development sleeve 111 is connected to a development bias supply 112 so that a development bias voltage from the development bias supply 112 is applied to the development sleeve, the bias voltage being a combination of an AC voltage and a DC voltage placed one over the other, so that a vibration field is caused to act on the development region.

Upstream of the development region in the direction of developer transport and at a position opposite to magnet pole N1 of the magnet roller 110, there is provided amagnetic blade 113 in spaced relation with the development sleeve 111 so that the quantity of developing agent on the development sleeve 111 is regulated by the magnetic blade 113.

In the development apparatus 100, a toner housing section 114 for housing toner T is provided on the top of the apparatus so that when the concentration of the toner in the developing agent within the development apparatus 100 drops as a result of development carried out with the toner in the developing agent from the development sleeve 111, a toner replenishing roller 115 is driven to rotate for supply of Toner T. The toner so supplied is mixed with the developing agent and agitated by a mixing-agitating member 116 and the mixture is supplied to the development sleeve 111.

In the development apparatus 100, the quantity of developing agent on the development sleeve 111 is regulated by the magnetic blade 113 so that the developing agent is laid in a thin layer condition on the development sleeve 111 for being transported to the development region. A development bias voltage from the development bias voltage supply 112 is applied so that a vibration field is caused to act on the development region so that the toner in the developing agent delivered by the development sleeve 111 is supplied from the development sleeve 111 to the electrostatic latent image portion of the photosensitive member 102 to enable development.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. A negatively chargeable non-magnetic yellow toner comprising:

non-magnetic toner particles containing a binder resin having an acid value of 1 to 30 KOHmg/g, and a coloring material composed of a compound classified as C. I. pigment yellow 180;

the toner particles having a roundness of 0.94 to 1.0, a standard roundness deviation of not more than 0.045, and a volume mean particle size of 2 to 9 $\mu$m.

2. A negatively chargeable non-magnetic yellow toner as defined in claim 1, wherein the toner particles have a roundness of 0.945 to 0.99 and a standard roundness deviation of not more than 0.040.

3. A negatively chargeable non-magnetic yellow toner as defined in claim 1, wherein the binder resin has a glass transition point of 55 to 70° C., a softening point of 95 to 120° C., a number-mean molecular weight of 2500 to 6000, with a ratio of weight-mean molecular weight to number-mean molecular weight being 2 to 8.

4. A negatively chargeable non-magnetic yellow toner as defined in claim 1, wherein the binder resin is a linear polyester resin obtained from a bisphenol-A alkylene oxide adduct and a phthalo-dicarboxylic acid.

5. A negatively chargeable non-magnetic yellow toner as defined in claim 1, further containing 0.5 to 5 parts by weight of wax relative to 100 parts by weight of the binder resin, the wax having an acid value of 0.5 to 30 KOHmg/g.

6. A negatively chargeable non-magnetic yellow toner as defined in claim 1, further containing 0.1 to 3% by weight of inorganic fine particles relative to the weight of the toner, the inorganic fine particles being externally added to the toner.

7. A negatively chargeable non-magnetic mono-component yellow toner, comprising:

non-magnetic toner particles containing a binder resin having an acid value of 1 to 30 KOHmg/g, and a coloring material composed of a compound classified as C. I. pigment yellow 180;

the toner particles having a roundness of 0.94 to 1.0, a standard roundness deviation of not more than 0.045, and a volume mean particle size of 2 to 9 $\mu$m.

8. A negatively chargeable non-magnetic mono-component yellow toner as defined in claim 7, wherein the binder resin has a glass transition point of 55 to 70° C., a softening point of 95 to 120° C., a number-mean molecular weight of 2500 to 6000, with a ratio of weight-mean molecular weight to number-mean molecular weight being 2 to 8.

9. A negatively chargeable non-magnetic mono-component yellow toner as defined in claim 8, wherein the binder resin is a linear polyester resin obtained from a bisphenol-A alkylene oxide adduct and a phthalo-dicarboxylic acid.

10. A negatively chargeable non-magnetic mono-component yellow toner as defined in claim 7, further containing 0.5 to 5 parts by weight of wax relative to 100 parts by weight of the binder resin, the wax having an acid value of 0.5 to 30 KOHmg/g.

11. A method of producing a non-magnetic yellow toner, comprising the steps of:

preparing a coloring resin solution containing a binder resin, a compound classified as C. I. pigment yellow 180, and a non-aqueous organic solvent;

emulsifying and dispersing the coloring resin solution in an aqueous medium, thereby to obtain an aqueous dispersion such that coloring resin solution particles are dispersed in an aqueous medium; and removing non-aqueous organic solvent from the coloring resin solution particles, thereby to obtain toner particles having a roundness of 0.94 to 1.0, a standard roundness deviation of not more than 0.045, and the volume mean particle size of 2 to 9 $\mu$m.

12. A method of producing a non-magnetic yellow toner as defined in claim 11, wherein the coloring resin solution comprises a master batch containing 10 to 100 parts by weight of a compound classified as C. I. pigment yellow 180 relative to 100 parts by weight of the binder resin, the binder resin and the non-aqueous organic solvent.

13. A method of producing a non-magnetic yellow toner comprising the steps of:

mixing a binder resin having an acid value of 1 to 30 KOHmg/g with a compound classified as C. I. pigment yellow 180;

melting and kneading the resulting mixture;

pulverizing the kneaded mixture;

classifying the pulverized particles; and adjusting roundness of the classified particles, to give toner particles having a roundness of 0.94 to 1.0 and a standard roundness deviation of not more than 0.045.

14. A method of producing a non-magnetic yellow toner as defined in claim 13, wherein the mixing step is a step for mixing a master batch containing 10 to 100 parts by weight of a compound classified as C.I. pigment yellow 180 relative to 100 parts by weight of the binder resin, and the binder resin together.

15. A method of producing a non-magnetic yellow toner as defined in claim 13, wherein thetoner particles have the volume-mean particle size of 2 to 9 $\mu$m , and contains not more than 2% by weight of coarse particles having a particle size of not less than two times a volume mean particle size thereof, and not more than 5% by number of fine particles, the fine particles having a particle size of not more than one third of the volume mean particle size.

16. A method of producing a non-magnetic yellow toner as defined in claim 13, wherein the step of adjusting the roundness pulverizing the kneaded mixture while adjusting roundness of pulverized particles and standard roundness deviation of the particles.

17. A method of producing a non-magnetic yellow toner as defined in claim 13, wherein the step of adjusting the roundness of toner particles is carried out at the classifying step by adjusting the roundness and standard roundness deviation of the particles while classifying the particles obtained at the pulverizing step.

18. A method of producing a non-magnetic yellow toner as defined in claim 13, wherein the step of adjusting the roudness of toner particles is carried out by adjusting the roundness and standard roundness deviation of the particles after the classifying step.

19. A negatively chargeable non-magnetic yellow toner as defined in claim 1, wherein the toner particles include not more than 2% by weight of course particles having a particle size of not less than two times the volume mean particle size thereof, and not more than 5% by number of fine particle having a particle size of not more than one third of the volume mean particle size.

20. A negatively chargeable non-magnetic mono-component yellow toner as defined in claim 7, wherein the toner particles include not more than 2% by weight of course particles having a particle size of not less than two times the volume mean particle size thereof, and not more than % by number of fine particles having a particle size of not more than one third of the volume mean particle size.

21. A method of producing a non-magnetic yellow toner as defined in claim 11, wherein the toner particles contain not more than 2% by weight of course particles having a particle size thereof, and not less than two times the volume mean particle size thereof, and not more than 5% by number of fine particles having a particle size of not more than one third of the volume mean particle size.

* * * * *